US009595240B1

(12) United States Patent
Gupta et al.

(10) Patent No.: US 9,595,240 B1
(45) Date of Patent: Mar. 14, 2017

(54) ADJUSTING FRONTLIGHT BRIGHTNESS DURING PAGE UPDATES

(71) Applicant: Amazon Technologies, Inc., Reno, NV (US)

(72) Inventors: Siddharth Gupta, San Bruno, CA (US); Scott Michael Dylewski, San Francisco, CA (US)

(73) Assignee: Amazon Technologies, Inc., Seattle, WA (US)

( * ) Notice: Subject to any disclaimer, the term of this patent is extended or adjusted under 35 U.S.C. 154(b) by 366 days.

(21) Appl. No.: 14/089,546

(22) Filed: Nov. 25, 2013

(51) Int. Cl.
*G09G 5/10* (2006.01)
*G09G 3/34* (2006.01)
*G09G 3/38* (2006.01)

(52) U.S. Cl.
CPC ..... *G09G 5/10* (2013.01); *G09G 3/34* (2013.01); *G09G 3/344* (2013.01); *G09G 3/38* (2013.01)

(58) Field of Classification Search
None
See application file for complete search history.

(56) References Cited

U.S. PATENT DOCUMENTS

| | | | | |
|---|---|---|---|---|
| 8,382,295 | B1 * | 2/2013 | Kim | H04N 9/31 348/552 |
| 8,545,035 | B1 * | 10/2013 | Beguin | G09G 3/3413 345/102 |
| 2013/0135215 | A1 * | 5/2013 | Bozarth | G06F 3/147 345/173 |
| 2014/0028735 | A1 * | 1/2014 | Williams | G09G 3/3406 345/690 |

* cited by examiner

*Primary Examiner* — Jennifer Mehmood
*Assistant Examiner* — Stephen T Reed
(74) *Attorney, Agent, or Firm* — Lee & Hayes, PLLC

(57) ABSTRACT

Techniques for adjusting a brightness of a front that lights a display of an electronic device in response to determining that the display is going to perform an update. Typically, page updates on certain types of displays, such as electronic paper displays, result in a relatively large but rapid change in brightness. Therefore, by increasing the brightness during the relatively dark portion of the update (e.g., when some, a majority, or all of the pixels are in the black state) and then decreasing the brightness back to its initial state upon completion of the update, the overall brightness perceived by the user remains more uniform. Increasing the uniformity of this perceived brightness in turn decreases the jarring affect of the flashing update and increases the experience of the user.

21 Claims, 5 Drawing Sheets

ADJUSTING FRONTLIGHT BRIGHTNESS DURING PAGE UPDATES

BACKGROUND

A large and growing population of users is enjoying entertainment through the consumption of digital content, such as music, movies, images, electronic books, and so on. The users employ various electronic devices to consume such content. Among these electronic devices are electronic book (eBook) reader devices, cellular telephones, personal digital assistants (PDAs), portable media players, tablet computers, and the like. Users read or otherwise view digital content on their devices in varying light conditions. In dim lighting conditions, changes in brightness caused by display updates may be quite noticeable to users and, in some instances, may be rather bothersome.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items or features.

DETAILED DESCRIPTION

Figure 1A:
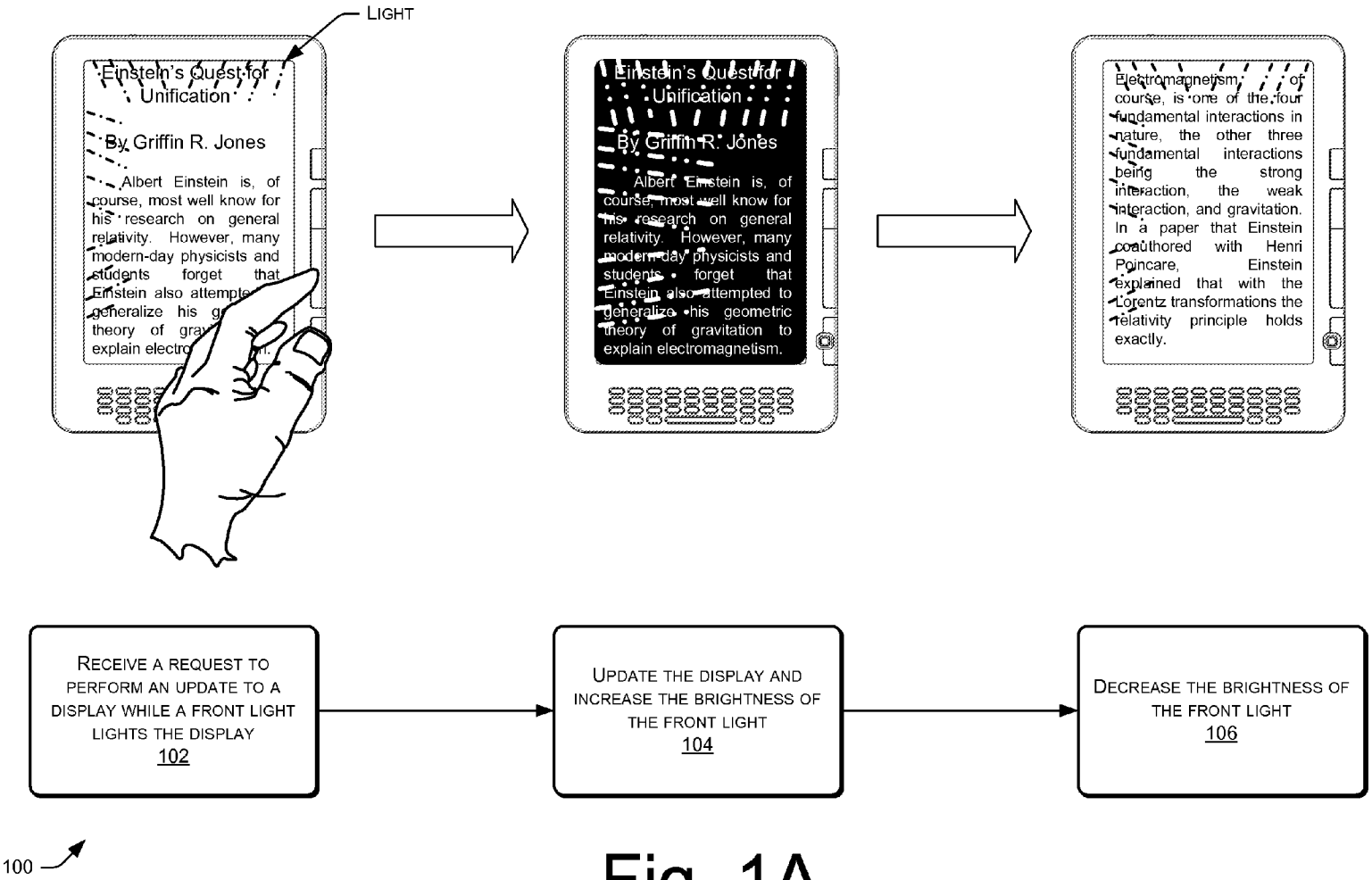
FIG. 1A illustrates an example scenario where an electronic device performs a display update and, during the update, increases a brightness of a frontlight that lights display, thereby lessening a change in brightness perceivable by the user. When the update is finished, the frontlight has returned to its initial brightness value.

This disclosure describes, in part, techniques for adjusting a brightness of a front that lights a display of an electronic device in response to determining that the display is going to perform an update. Typically, page updates on certain types of displays, such as electronic paper displays, result in a relatively large but rapid change in reflectivity, which changes how much light is reflected off of the display. For instance, when an electronic paper display performs a "flashing" update, by moving some or all pixels of the display to black states and then to states associated with pixel values defined by the new content to be rendered on the display, this flashing effect can be quite jarring to a user. Therefore, by increasing the brightness during the relatively dark portion of the update (e.g., when some, a majority, or all of the pixels are in the black state) and then decreasing the brightness back to its initial state upon completion of the update, the overall brightness perceived by the user remains more uniform. Increasing the uniformity of this perceived brightness in turn decreases the jarring affect of the flashing update and increases the experience of the user.

Devices as described herein may include a frontlight-adjustment component that functions to determine when a display is going to perform an update and, in response, adjust the brightness of a frontlight lighting the display. The frontlight may or may not be integral to the device. In the latter instances, the frontlight may physically or wirelessly couple to the frontlight-adjustment component such that that the latter component is able to cause the frontlight to alter its brightness. The frontlight-adjustment component, meanwhile, may be implemented in software, hardware, or a combination thereof.

When implemented at least in part via software, the frontlight-adjustment component may comprise instructions that are executable on one or more processors to identify when an application executing on a device issues a request to a display controller associated with the display to present new content. In response, the frontlight-adjustment component may instruct a frontlight controller to adjust its brightness in a certain way, such as according to a particular brightness adjustment profile.

When implemented at least in part via hardware, the frontlight-adjustment component may comprise a microcontroller that identifies when a particular voltage is applied to the display for altering content presented on the display. For instance, the microcontroller may monitor a display power line to determine when a common voltage ($V_{com}$) signal is applied to the display, which may be applied for helping "wipe" the display or otherwise refresh the pixel values. Of course, in other instances, the microcontroller may identify any other type of voltage signal applied to the display. After identifying that the $V_{com}$ signal has been applied, the microcontroller may then instruct the frontlight controller to adjust its brightness to decrease the possible noticeable effect of the flashing update in terms of change in brightness. For instance, the microcontroller may include a timer to at least one of determine when to instruct the frontlight controller to adjust the brightness of the frontlight or determine instructions to provide to the frontlight controller pertaining to when the frontlight controller is to adjust the brightness of the frontlight.

Of course, while one hardware example has been described, it is to be appreciated that other implementations may be used. For instance, a camera or other optical sensor may monitor the display to identify when a page transition is triggered and, in response, the frontlight maybe adjusted.

Regardless of whether the frontlight-adjustment component is implemented in hardware, software, or a combination thereof, this component may instruct a frontlight-controller to alter a brightness of the frontlight according to a predefined brightness adjustment profile. This profile may indicate how the brightness of the frontlight is to change over time, such as indicating that the brightness is to increase from a first, initial value at a time of a beginning of an update to a second, greater value, and back to the first initial value.

In some instances, the frontlight-adjustment component references one or more factors when selecting or calculating the appropriate brightness profile. For instance, the electronic device may include an ambient light sensor to determine an amount of ambient light and may reference this measured amount of light to determine how to adjust the brightness of the frontlight. In one example, the frontlight-adjustment component may first determine whether the amount of ambient light is less than a threshold amount and, if so, may determine to adjust the frontlight in response. That is, the adjustment component may determine whether the electronic device is operating in low-light conditions and, if so, may implement the techniques described herein for the purpose of avoiding the jarring affects of the extreme changes in brightness. In other instances, meanwhile, the adjustment component may determine whether the amount of ambient light is greater than a different, second threshold and, if so, may also determine to adjust the frontlight in response. In these instances, however, because the device would be operating in bright-light conditions, the component may decrease the frontlight and then increase the frontlight, rather than vice versa.

In addition, the component may reference this measured amount of ambient light in determining the profile to use when adjusting the frontlight. That is, the component may determine, for example, how much to increase and/or decrease the brightness of the frontlight and for how long based on the ambient light surrounding the device.

In addition or in the alternative, the frontlight-adjustment component may reference content presented on the display when determining how to adjust a frontlight. For instance, this component may estimate a brightness of first content presented on the display (e.g., a first page of an electronic book presented on the display) as well as a second content that is to be presented (e.g., a second page of the electronic book). The frontlight-adjustment component may analyze the pixel values of these pieces of content to determine the brightness of the content as well as the change in brightness between the first content, the pixel values when updated/flashed, and the second content.

Furthermore, some displays, such as electronic paper displays, implement one or more of multiple different waveforms when a corresponding display controller performs a specified page update. In some instances, the display update (e.g., the page transition) may implement a "flashing" update, which includes causing each pixel to be rendered as either dark (e.g., black) or light (e.g., white) before being rendered according to a value specified by the content. For instance, if a pixel is initially white but has a value corresponding to gray according to content that is to be rendered on the display, then the display controller 104 may initially render this pixel black before rendering it in the specified gray. This use of flashing updates helps alleviate ghosting effects from previously rendered content in some instances. Ghosting refers to the phenomenon when an erased image still appears in a very small but perceivable manner on the display. Ghosted images often appear when corresponding images have been erased from physical paper on which these images were drawn. For instance, if an electronic paper display presents three images sequentially, pixel values of the first image may create some "ghosting" effects when the third is image is presented. That is, these pixel values of the first image may still be at least partly visible when the device presents the third image. Of course, while some implementations may utilize flashing updates, other implementations may utilize any other type of update and/or waveform.

In some instances, the frontlight adjustment component may implement the described techniques in response to determining that the display controller is going to implement a particular waveform, such as a waveform intended to flash the display. Additionally, this component may determine a brightness profile to implement based at least in part on the implemented waveform.

The techniques described herein may be implemented in a variety of ways and by a variety of electronic devices. While a few examples are illustrated and described below, it is to be appreciated that other electronic devices may implement these techniques. Furthermore, it is noted that because electronic books are structured as virtual frames presented on a computing device, the term "page" as used herein refers to a collection of content presented at one time on a display. Thus, "pages" as described herein are not fixed permanently, and may be redefined or repaginated based on variances in display conditions, such as screen size, font type or size, margins, line spacing, resolution, or the like.

In addition, the term "electronic book", "eBook", "content", or "content item" as used herein, may include any type of content which can be stored and distributed in digital form. By way of illustration, and without limitation, electronic books and content items can include all forms of textual information such as books, magazines, newspapers, newsletters, periodicals, journals, reference materials, telephone books, textbooks, anthologies, proceedings of meetings, forms, directories, maps, manuals, guides, references, photographs, articles, reports, documents, etc., and all forms of audio and audiovisual works such as music, multimedia presentations, audio books, movies, etc.

FIG. 1A illustrates an example scenario 100 where an electronic device performs a display update and, during the update, increases a brightness of a frontlight that lights display, thereby lessening a change in brightness perceivable by the user. When the update is finished, the frontlight has returned to its initial brightness value.

At 102, the illustrated electronic device receives a request to perform an update to a display of the electronic device while a frontlight lights the displays. As illustrated, at the time of receiving this request the display currently displays a first page of an electronic book and the frontlight utilizes a first brightness value (e.g., as set by a user) for illuminating the display. In this example, the frontlight is integral with the display. For example, the device may include one or more lights (e.g., LEDs) underneath the bezel of the display that emit light across the display. The display may then be coated with a refractive material that guides the light onto the display, thus causing the light to reflect off of and light the display.

At 104, the device updates the display and, at least partly during the updating, adjusts the brightness of the frontlight by increasing a brightness of the frontlight to a second, greater brightness value. At 106, the electronic device then decreases the brightness of the frontlight back to the first brightness value such that the user-set brightness level is implemented when the second page of content is rendered.

In the example, the display controller "flashed" the display. That is, on the illustrated example, the electronic display includes pixels configured to transition between a white state and a black state, and the display controller "flashes" the display such that previously black or gray pixels transition to white and vice versa. Here, a frontlight adjustment component of the device may increasing the brightness of the frontlight to the second brightness value when some, a majority, or all of the pixels are at the black state or transitioning towards the black state. Conversely, the decreasing the brightness of the frontlight from the second brightness value to the first brightness value may occur at least partly when the majority of the pixels are at the white state or transitioning towards the white state. By doing so, the frontlight brightness increases when the display is relatively dim, and deceases when the display is relatively bright, thus smoothing the overall brightness perceived by the user and reducing the jarring affects caused by extreme brightness changes.

Figure 1B:
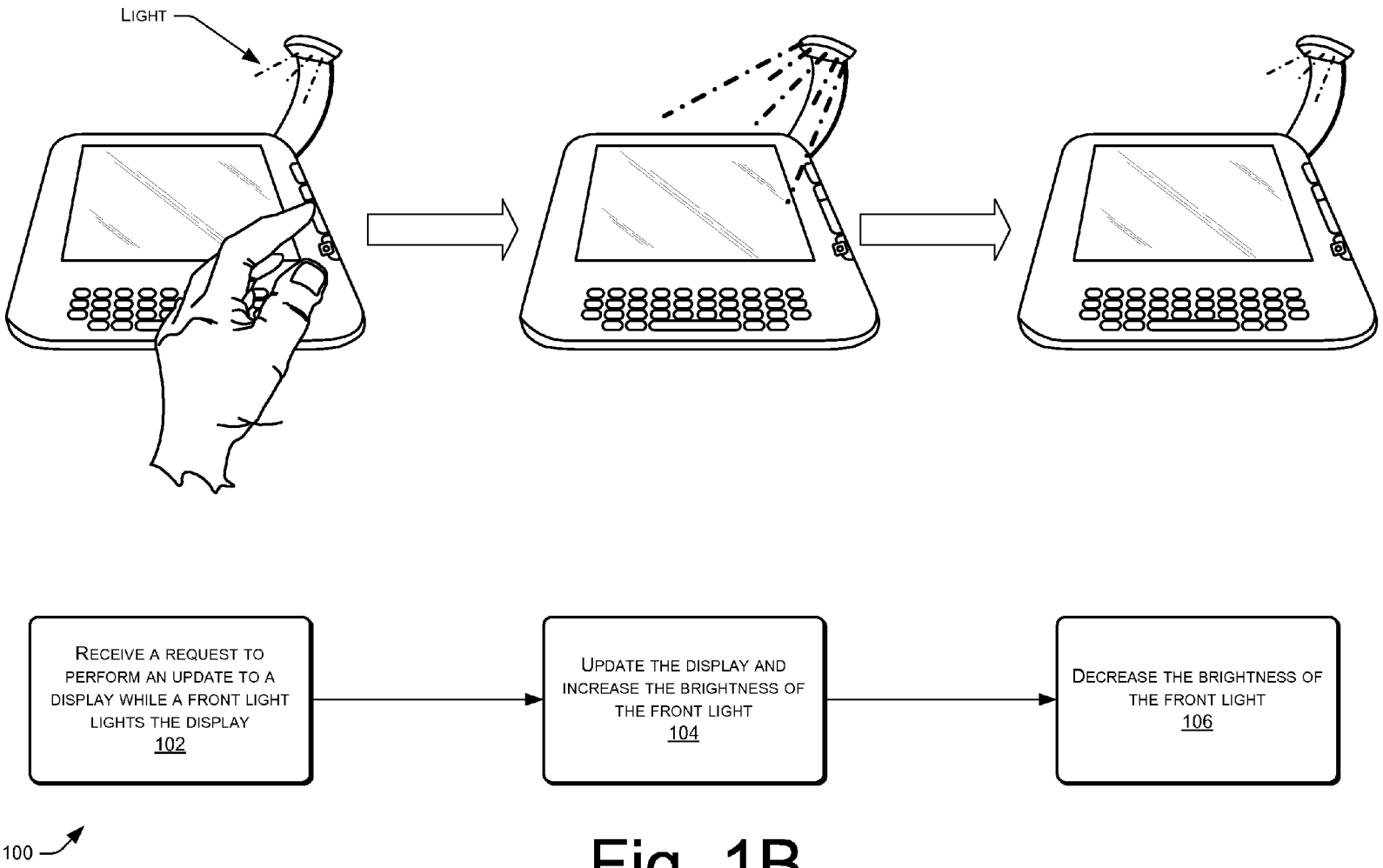
FIG. 1B illustrates an example scenario similar to the scenario of FIG. 1A, although in this instances the frontlight that lights the display of the electronic device is not integral to the device.

FIG. 1B illustrates an example scenario 108 similar to the scenario of FIG. 1A, although in this instances the frontlight that lights the display of the electronic device is not integral to the device. For instance, the frontlight in this example may removably couple to the device. For instance, the frontlight may "snap on" to the device, may be reside within a cover that couples to the device, or the like. In either case, the frontlight-adjustment component of the device may communicate with the frontlight in a wired and/or wireless manner to instruct the non-integral frontlight to implement a certain brightness profile.

Figure 2:
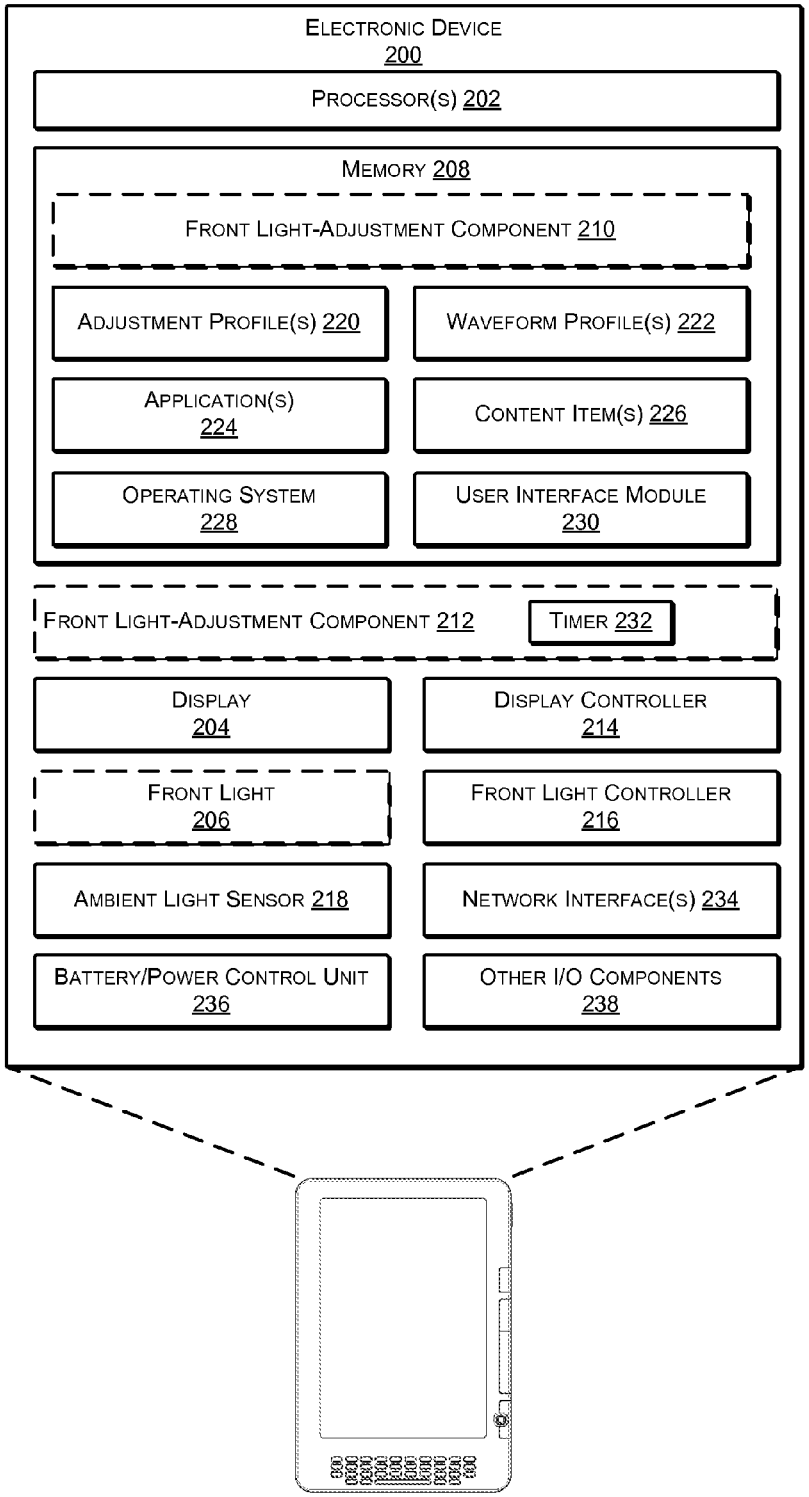
FIG. 2 illustrates example components of an electronic device configured to adjust a brightness of a frontlight that lights a display of the device, in response to determining that the display is going to be updated.

FIG. 2 illustrates example components of an electronic device 200 configured to adjust a brightness of a frontlight that lights a display of the device, in response to determining that the display is going to be updated. While FIG. 1 illustrates the device 100 as a dedicated electronic book reading device, in other implementations the device 100 may comprise any other type of mobile electronic device (e.g., a laptop computer, a tablet computing device, a multifunction communication device, a portable digital assistant (PDA), etc.) or non-mobile electronic device (e.g., a desktop computer, a television, etc.).

Regardless of the specific implementation of the electronic device 200, this device 200 includes one or more processors 202, a display 204, a frontlight 206, and memory 208. In some instances, the electronic device 200 utilizes a frontlight-adjustment component 210 stored in memory and executable on the processors to adjust a brightness of a frontlight. In other instances, the device 200 utilizes a frontlight-adjustment component 212 in hardware to perform this task. In some instances, the frontlight-adjustment component might comprise a microcontroller that resides in the processor(s) 202.

In either case, a display controller 214 controls the updating of the display 204, while a frontlight controller 216 controls the frontlight 206. A frontlight may be integrated, as shown in FIG. 1A. In these instances, one or more light sources (e.g., LEDs) may reside around some or all of a display, and may be illuminated when desired. The display surface may include diffractive gratings (e.g., having a sawtooth cross-sectional profile) that diffracts light received across the surface of the display down onto the display. The display then reflects the light back upwards, thus lighting the display. In other instances, the frontlight may detachably couple to the device, as shown in FIG. 1B. Of course, while two examples are shown, devices may implement any other types of lights configured to light a front portion of a display of the device. The frontlight controller 216, meanwhile, may comprise a portion of the main processing unit of the device, or may comprise a separate microcontroller or driver.

In addition, the device 200 includes an ambient light sensor that is configured to measure the amount of ambient light in an environment surrounding the electronic device 200. In some instances, the adjustment component 210 or 212 compares the measured ambient light to a threshold and implements the frontlight adjustment techniques at least partly in response to determining that the ambient light is less than a threshold (i.e., the device is being used in dim lighting conditions).

In some instances, the display 204 represents a type of reflective display, such as an electronic paper display, that displays content based on light reflected from above the display. Electronic paper displays represent an array of display technologies that largely mimic the look of ordinary ink on paper. In contrast to conventional backlit displays, electronic paper displays typically reflect light, much as ordinary paper does. In addition, electronic paper displays are often bi-stable, meaning that these displays are capable of holding text or other rendered images even when very little or no power is supplied to the display.

In one implementation, the electronic paper display comprises an electrophoretic display that moves particles between different positions to achieve different color shades. For instance, in a pixel that is free from a color filter, the pixel may be configured to produce white when the particles within this pixel are located at the front (i.e., viewing) side of the display. When situated in this manner, the particles reflect incident light, thus giving the appearance of a white pixel. Conversely, when the particles are pushed near the rear of the display, the particles absorb the incident light and, hence, cause the pixel to appear black to a viewing user. In addition, the particle may situate at varying locations between the front and rear sides of the display to produce varying shades of gray. Furthermore, as used herein, a "white" pixel may comprise any shade of white or off white, while a "black" pixel may similarly comprise any shade of black.

In another implementation, the electronic paper display 102 comprises an electrophoretic display that includes oppositely charged light and dark particles. In order to create white, the display controller moves the light particles to the front side of the display by applying a voltage to create a corresponding charge at an electrode near the front and moves the dark particles to the back of the display by creating a corresponding charge at an electrode near the back. In order to create black, meanwhile, the display controller changes the polarities and moves the dark particles to the front and the light particles to the back. Furthermore, to create varying shades of gray, the display controller may utilize different arrays of both light and dark particles.

In still another implementation, the electronic paper display comprises an electrowetting display that employs an applied voltage to change the surface tension of a liquid in relation to a surface. For instance, by applying a voltage to a hydrophobic surface, the wetting properties of the surface can be modified so that the surface becomes increasingly hydrophilic. As one example of an electrowetting display, the modification of the surface tension acts as an optical switch by contracting a colored oil film when a voltage is applied to individual pixels of the display. When the voltage is absent, the colored oil forms a continuous film within a pixel, and the color may thus be visible to a user of the display. On the other hand, when the voltage is applied to the pixel, the colored oil is displaced and the pixel becomes transparent. When multiple pixels of the display are independently activated, the display can present a color or grayscale image. The pixels may form the basis for a transmissive, reflective, or transmissive/reflective (transreflective) display. Further, the pixels may be responsive to high switching speeds (e.g., on the order of several milliseconds), while employing small pixel dimensions. Accordingly, the electrowetting displays herein may be suitable for applications such as displaying video content. In addition, the lower power consumption of electrowetting displays in comparison to conventional LCD displays makes the technology suitable for displaying content on portable devices that rely on battery power.

Of course, while three different examples have been given, it is to be appreciated that the electronic paper displays described herein may comprise any other type of electronic paper technology, such as gyricon displays, electrowetting displays, electrofluidic displays, interferometric modulator displays, cholestric liquid crystal displays, and the like. In addition, while some of the displays described below are discussed as rendering dark (e.g., black), light (e.g., white), and varying shades of gray, it is to be appreciated that the described techniques apply equally to electronic paper displays capable of rendering color pixels.

Furthermore, while the techniques above describe the use of reflective displays and frontlights, in some instances the techniques described herein may be used in backlit displays. For instance, the brightness of a backlight in a display may be altered in the same, similar or different ways as described herein with reference to a page-update on a reflective display.

Figure 3:
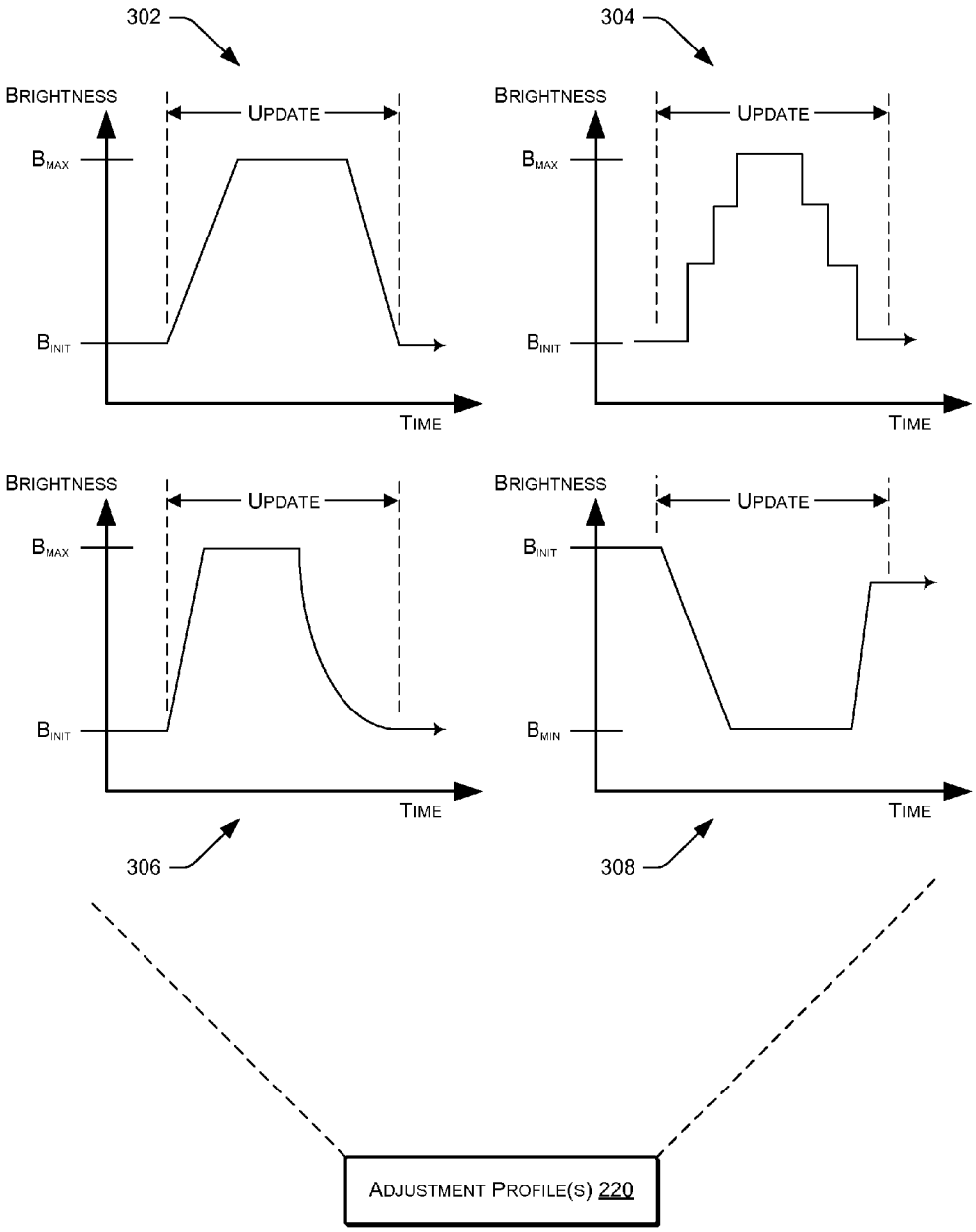
FIG. 3 illustrates example adjustment profiles that a frontlight-adjustment component may utilize when adjusting a brightness of a frontlight.

The memory 208 may be used to store any number of functional components that are executable on the processors 202, as well as data and content items that are rendered by the electronic device 100. The memory 208 may include one or more adjustment profiles 220 that indicate how a brightness of a frontlight is to be changed over time in response to the display 204 implementing a flashing update in low-light conditions. FIG. 3 illustrates example profiles 220 in further detail.

In addition, the memory 208 stores one or more waveform profiles 222 that the display controller 214 may utilize when updating the display. The update type may specify which of multiple different waveforms that the display controller 214 will implement when performing the specified update. As described above, in some instances, the page transition may implement a "flashing" update, which includes causing each pixel to be rendered as either black or white before being rendered according to a value specified by the content. Of course, while some implementations may utilize flashing updates, other implementations may utilize any other type of update and/or waveform.

As illustrated, the memory 208 may further store one or more applications 224 and one or more content items 226, as well as an operating system 228 and a user interface module 230. The content items 226 such as eBooks, audio books, songs, videos, still images, and the like. In some instances, one or more of the applications 224 comprise content presentation applications for presenting the content items. For instance, the application may be an electronic book reader application for rending textual electronic books, an audio player for playing audio books or songs, a video player for playing video, and so forth.

As described above, the frontlight-adjustment components 210 and/or 212 may determine when the display controller 214 is going to be perform a update to the display and, at least partly in response, instruct the frontlight controller 216 to adjust a brightness of the frontlight 206, which may or may not be integral with the device. In some instances, the frontlight controller 216 increases the brightness of the frontlight 206 when the update alters a state of at least a portion of the multiple pixels to a black state and then decreases the brightness of the frontlight 206 when the update alters a state of the pixels to a state associated with content to be presented at each respective pixel (e.g., pixel values associated with a next page of an electronic book).

Furthermore, in some instances described above, the frontlight-adjustment component 210 and/or 212 may reference content that is to be presented when determining how to adjust the brightness of the frontlight 206. In these instances, the component 210 and/or 212 determines pixel values associated with content to be presented on the display after the update and determines how to instruct the frontlight controller 216 to adjust the brightness of the frontlight based at least in part on the pixel values.

Additionally or alternatively, the frontlight-adjustment component 210 and/or 212 may reference a waveform that is going to be used when updating the display when determining how to adjust the brightness of the frontlight 206. The frontlight-adjustment component 210 and/or 212 then determines how to instruct the frontlight controller 216 to adjust the brightness of the frontlight 206 based on the waveform to be used. For instance, the frontlight-adjustment component 210 and/or 211 may instruct the frontlight controller 216 to adjust the brightness of the frontlight 206 in response to determining that the impending display update comprises a flashing update.

When the electronic device 200 implements the software-based frontlight-adjustment component 210, this component 210 may identify when one of the applications 224 issues a request to update the display 204 (e.g., for the purpose of displaying a subsequent page of an electronic book). In response, the component 210 may determine to adjust a brightness of the frontlight 206.

When the electronic device 200 implements the hardware-based frontlight-adjustment component 212, meanwhile, this component 212 may monitor a value of a common voltage ($V_{com}$) signal applied to the display. In some instances, the $V_{com}$ signal is applied to the display 204 when the display controller 214 is about to "wipe" the display by implementing a flashing update. As such, in response to the component determining that the $V_{com}$ signal is greater than a threshold (e.g., goes from an off to an state), the frontlight-adjustment component 212 may determine that the display controller is going to perform the update to the display based at least in part on determining that the value of the $V_{com}$ signal has exceeded the threshold. At this point, the component 212 may prepare to adjust the brightness of the frontlight 206. For instance, the component 212 may utilize a timer 232 that determines when to cause to frontlight controller 216 to adjust the brightness of the frontlight 206. For instance, the component 212 may utilize the timer 232 to determine when to instruct the frontlight controller 216 to adjust the brightness of the frontlight 216 or may use the timer 232 to determine instructions to provide to the frontlight controller 216 pertaining to when the frontlight controller 216 is to adjust the brightness of the frontlight 206.

FIG. 1 further illustrates that the electronic device 200 includes one or more network interfaces 234, one or more power sources 236 that provide power to the device 200, and one or more other input/output components 238. The network interfaces 234 may support both wired and wireless connection to various networks, such as cellular networks, radio, WiFi networks, short range networks (e.g., Bluetooth), IR, and so forth.

Depending on the configuration of the electronic device 200, the memory 208 (and other computer-readable media described throughout) is an example of computer storage media and may include volatile and nonvolatile memory. Thus, the memory 208 may include, but is not limited to, RAM, ROM, EEPROM, flash memory, or other memory technology, or any other medium which can be used to store media items or applications and data which can be accessed by the electronic device 100.

In some instances, the electronic device 200 may have features or functionality in addition to those that FIG. 1 illustrates. For example, the device 100 may also include additional data storage devices (removable and/or non-removable) such as, for example, magnetic disks, optical disks, or tape. The additional data storage media may include volatile and nonvolatile, removable and non-removable media implemented in any method or technology for storage of information, such as computer readable instructions, data structures, program modules, or other data. In addition, some or all of the functionality described as residing within the device 200 may reside remotely from the device 200 in some implementations. In these implementations, the device 200 may utilize the network interfaces 234 to communicate with and utilize this functionality.

Various instructions, methods and techniques described herein may be considered in the general context of computer-executable instructions, such as program modules, executed by one or more computers or other devices. Generally, program modules include routines, programs, objects, components, data structures, etc. for performing particular tasks or implement particular abstract data types. These program modules and the like may be executed as native code or may be downloaded and executed, such as in a virtual machine or other just-in-time compilation execution environment. Typically, the functionality of the program modules may be combined or distributed as desired in various embodiments. An implementation of these modules and techniques may be stored on or transmitted across some form of computer readable media.

FIG. 3 illustrates example adjustment profiles that a frontlight-adjustment component 210 and/or 212 may utilize when adjusting a brightness of a frontlight 206. As illustrated, each example profile illustrates how a brightness of a frontlight may be instructed to change over time in response to determining that the display is going to perform an update.

A first example profile 302 illustrates that a user may be utilizing a frontlight at an initial brightness ($B_{init}$) prior to a display update occurring. Sometime after (e.g., substantially immediately after) a display update (e.g., a flashing update) begins to occur, the frontlight controller may increase the brightness linearly (or in any other manner) to a maximum brightness ($B_{max}$). The frontlight may maintain this brightness for a certain amount of time, such as while the display is relatively dark during the flash, before transitioning back to or substantially back to the initial brightness level.

A second example profile 304 again illustrates increasing a frontlight from an initial brightness to a maximum brightness and then back down to the initial value. In this example, however, the frontlight controller instructs to increase and decrease the front-light brightness in a stair-step manner. A third example profile 306, meanwhile, illustrates that the frontlight controller may instruct the frontlight to increase its brightness from an initial value to a maximum value linearly, while implementing some sort of exponential decay when decreasing the frontlight from the maximum brightness value back to the initial brightness value.

A fourth example profile 308, meanwhile, illustrates an opposite example. Here, the frontlight controller decreases the brightness of a frontlight from an initial value to a minimum brightness value ($B_{min}$) in response to the display controller updating the display. Thereafter, the frontlight controller increases a brightness of the frontlight, although not to the same amount as prior to the update. In this example, the frontlight controller increases the brightness to a value that is less than the initial value. Note, however, that while FIG. 3 illustrates four example profiles, in other instances the controller may implement any other number of similar or different adjustment profiles.

Figure 4:
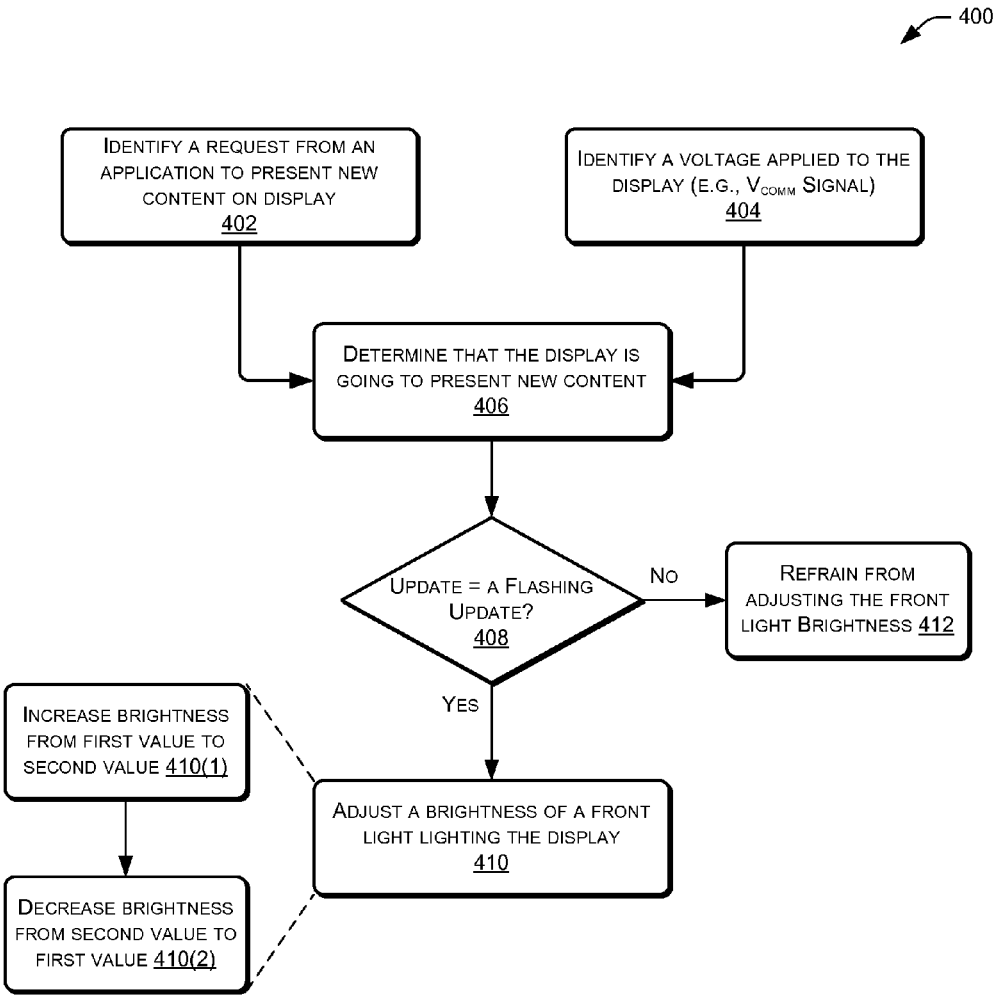
FIG. 4 illustrates an example flow diagram of adjusting a brightness of a frontlight in response to determining that a device is about to perform a flashing update.

FIG. 4 illustrates an example process 400 of adjusting a brightness of a frontlight in response to determining that a device is about to perform a flashing update. This process (as well as each process described herein) is illustrated as a logical flow graph, each operation of which represents a sequence of operations that can be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations can be combined in any order and/or in parallel to implement the process.

The process 400 includes, at 402, identifying a request from an application executing on a device to present new content on a display. At 404, meanwhile, the process alternately identifies a voltage (e.g., a $V_{com}$ signal) being applied to the display. In either instance, at 406 determines that the display is going to transition from presenting first content to presenting the new content based on the operation 402 or the operation 404.

At 406, the process 400 determines whether the display update to present the new content is going to be a flashing update (in this example) or another type of update. If so, then at 410 the process 400 adjusts a brightness of a frontlight lighting the display at least partly during the transition from the first content to the new content. This may include, at 410(1), increasing a value of the brightness from a first value to a second value, as well as decreasing the value of the brightness from the second value to the first value at 410(2). If, however, the process determines at 408 that the device is not going to be flashed, then at 412 the process 400 refrains from adjusting a brightness of the frontlight.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method comprising:

under control of a device that includes an electronic paper display, a display controller to control updating of the electronic paper display, a frontlight to light the electronic paper display, and a frontlight controller to control the frontlight, displaying, on the electronic paper display, a first page of an electronic book while the frontlight lights the electronic paper display at a first brightness value;

receiving a first request, the first request comprising a request to display a second, subsequent page on the electronic paper display;

updating, by the display controller and at least partly in response to the receiving of the first request, the electronic paper display to display the second page of the electronic book;

receiving, at least partly in response to the receiving of the first request, a second request, the second request comprising a request to increase a brightness of the frontlight from first brightness value to a second brightness value during the updating and to decrease the brightness from the second brightness value to the first brightness value upon completion of the updating, wherein the second brightness value is greater than the first brightness value;

approximately contemporaneously with commencement of the updating, increasing, by the frontlight controller, the brightness of the frontlight to the second brightness value; and decreasing, by the frontlight controller, the brightness of the frontlight to the first brightness value approximately contemporaneously with completion of the updating.

2. A method as recited in claim 1, wherein:

the electronic paper display includes pixels configured to transition between a light state and a dark state; and the increasing the brightness of the frontlight to the second brightness value occurs at least partly during a portion of the updating when a majority of the pixels are at least one of at the dark state or transitioning towards the dark state.

3. A method as recited in claim 2, wherein the decreasing the brightness of the frontlight from the second brightness value to the first brightness value occurs at least partly when the majority of the pixels are at least one of at the light state or transitioning towards the light state.

4. A device comprising:

a display to present first content;

a display controller to control updating of the display;

a frontlight to light the display at a first brightness level;

a frontlight controller to control the frontlight; and a frontlight-adjustment component configured to perform actions comprising:

determining that the display controller has been instructed to update the display to present second content; and sending, at least partly in response to determining that the display controller has been instructed to update the display to present the second content, an instruction to the frontlight controller to adjust a brightness of the frontlight from the first brightness level to a second brightness level during updating of the display and from the second brightness level to the first brightness level or a third brightness level upon completion of the updating of the display.

5. A device as recited in claim 4, wherein the second brightness level is greater than the first brightness level.

6. A device as recited in claim 5, wherein the third brightness level is less than both the first brightness level and the second brightness level.

7. A device as recited in claim 6, wherein:

the display comprises an electronic paper display comprising a first pixel;

the updating comprises altering a state of the first pixel to a dark state and then from the dark state to a state associated with content to be presented on the display at the first pixel; and the sending comprises sending an instruction that:

instructs the frontlight controller to increase the brightness of the frontlight to the second brightness level when the first pixel is in the dark state; and instructs the frontlight controller to decrease the brightness of the frontlight to the third brightness level when the first pixel is at the state associated with the content to be presented on the display at the first pixel.

8. A device as recited in claim 4, wherein the frontlight-adjustment component is further configured to perform actions comprising:

determining pixel values associated with the second content; and determining a value of at least one of the second brightness level or the third brightness level based at least in part on the pixel values.

9. A device as recited in claim 4, wherein the frontlight-adjustment component is further configured to perform actions comprising:

determining a waveform that the display controller will use when updating the display; and determining a value of at least one of the second brightness level or the third brightness level based at least in part on the waveform.

10. A device as recited in claim 4, wherein the frontlight-adjustment component is further configured to perform actions comprising:

determining that the updating of the display comprises performing a flashing update; and wherein the sending the instruction comprises sending the instruction at least partly in response to determining that the updating of the display comprises performing the flashing update.

11. A device as recited in claim 4, further comprising an ambient light sensor to measure an amount of ambient light, and wherein:

the frontlight-adjustment component is further configured to perform an action comprising determining whether the amount of ambient light is less than a first threshold or greater than a second threshold; and the sending of the instruction occurs at least partly in response to determining that the amount of ambient light is less than the first threshold or greater than the second threshold.

12. A device as recited in claim 4 further comprising:

one or more processors; and memory;

and wherein the frontlight-adjustment component is stored in the memory and executable on the one or more processors to perform the determining and the sending of the instruction.

13. A device as recited in claim 12, further comprising:

an application stored in the memory and executable on the one or more processors to issue a request to the display controller to perform the update;

and wherein the frontlight-adjustment component is further configured to recognize the request made from the application to the display controller.

14. A device as recited in claim 4, wherein the frontlight-adjustment component comprises a microcontroller configured to perform the determining and the sending of the instruction.

15. A device as recited in claim 14, wherein the frontlight-adjustment component is further configured to perform actions comprising:

monitoring a value of a common voltage ($V_{com}$) signal applied to the display; and determining that the value of the $V_{com}$ signal exceeds a threshold;

and wherein the frontlight-adjustment component is configured to perform an action comprising determining, based at least in part on determining that the value of the $V_{com}$ signal has exceeded the threshold, that the display controller is going to update to the display.

16. A device as recited in claim 15, wherein the frontlight-adjustment component comprises a timer, the frontlight-adjustment component using the timer to at least one of determine when to send the instruction.

17. A method comprising:

under control of a device that includes or couples to a display to present first content, a display controller to control updating of the display, a frontlight to light the display at a first brightness level, a frontlight controller to control the frontlight, and specific executable instructions, determining that the display driver is going to update the display from presenting the first content to presenting second content; and sending, at least partly in response to the determining that the display driver is going to update the display, an instruction to the frontlight controller to adjust a brightness of the frontlight from the first brightness level to a second brightness level during updating of the display and from the second brightness level to the first brightness level or a third brightness level upon completion of the updating of the display.

18. A method as recited in claim 17, wherein:

the display comprises an electronic paper display comprising multiple pixels;

the updating includes applying a voltage to the electronic paper display to move a majority of the multiple pixels to a dark state; and the adjusting sending the instruction comprises sending an instruction to adjust the brightness of the frontlight from the first brightness level to the second brightness level when the majority of the multiple pixels are at or transitioning towards the dark state.

19. A method as recited in claim 17, wherein the second brightness value is greater than the first brightness value.

20. A method as recited in claim 19, further comprising recognizing a request from an application executing on the device to present the second content, and wherein the determining occurs at least partly in response to identifying the request from the application.

21. A method as recited in claim 19, further comprising recognizing a voltage is applied to the display, and wherein the determining occurs at least partly in response to identifying that the voltage is applied to the display.

* * * * *